US007210171B2

(12) United States Patent
Jacobs et al.

(10) Patent No.: US 7,210,171 B2
(45) Date of Patent: May 1, 2007

(54) CLEANING GLOVE

(76) Inventors: Erin J. Jacobs, P.O. Box 1285, Hogansburg, NY (US) 13655; Jeremy S. McDonald, P.O. Box 1285, Hogansburg, NY (US) 13655

( * ) Notice: Subject to any disclaimer, the term of this patent is extended or adjusted under 35 U.S.C. 154(b) by 0 days.

(21) Appl. No.: 10/987,841

(22) Filed: Nov. 12, 2004

(65) Prior Publication Data

US 2006/0107439 A1 May 25, 2006

(51) Int. Cl.
*A41D 19/00* (2006.01)

(52) U.S. Cl. ..... 2/160; 2/161.6; 2/159; 15/227

(58) Field of Classification Search ..... 2/161.6, 2/164, 168, 161.8, 169, 161.7, 158, 159, 2/167; 15/227
See application file for complete search history.

(56) References Cited

U.S. PATENT DOCUMENTS 1,055,838 A * 3/1913 Torrance ..... 2/161.8
2,227,707 A 1/1941 Cooper
2,745,128 A 5/1956 Zeuner
2,895,139 A * 7/1959 Compton ..... 2/161.8
3,643,386 A * 2/1972 Grzyll ..... 451/523
3,857,133 A * 12/1974 Linenfelser ..... 15/118
4,038,787 A 8/1977 Bianchi
4,107,840 A 8/1978 Kupperman et al.
4,149,296 A * 4/1979 Stanford ..... 452/103
4,149,601 A * 4/1979 Taylor ..... 172/370
4,593,427 A * 6/1986 Ortolivo ..... 15/227
4,621,388 A 11/1986 Ortolivo
5,127,976 A 7/1992 McLeish et al.
5,441,355 A * 8/1995 Moore ..... 401/7
5,644,796 A * 7/1997 Laughlin ..... 2/161.6
6,000,060 A 12/1999 Borucki-Mastej
6,016,571 A 1/2000 Guzman et al.
6,018,837 A * 2/2000 Andreu ..... 15/118
6,367,116 B1 * 4/2002 DeBartolo ..... 15/245
6,460,190 B1 * 10/2002 Blum ..... 2/158
6,513,998 B1 * 2/2003 Barry ..... 401/7
D479,972 S * 9/2003 Cueto ..... D8/90

* cited by examiner

*Primary Examiner*—Gary L. Welch
*Assistant Examiner*—Richale L. Haney
(74) *Attorney, Agent, or Firm*—Dale J. Ream

(57) ABSTRACT

A cleaning glove includes a waterproof glove having at least one finger stall and a thumb stall, a mounting plate attached to the thumb stall, an artificial thumbnail connected to the mounting plate, a first scouring surface positioned on a thumbward side and an outer end of a first finger stall, a second scouring surface positioned on an exterior side of an outermost finger stall, a cleaning material, and an arm portion. The thumbnail has a generally crescent-shaped configuration protruding from the thumb stall for scraping objects when a wearer's thumb moves in a back and forth motion. The configuration and the positioning of the thumbnail provide the user with leverage when cleaning and take advantage of the hand's natural movements. The mounting plate distributes the thumbnail's forces on the waterproof glove, keeping the waterproof glove from tearing. The first and second scouring surfaces may be used cooperatively for cleaning.

1 Claim, 4 Drawing Sheets

CLEANING GLOVE

BACKGROUND OF THE INVENTION

This invention relates generally to a glove with specialized cleaning surfaces. In particular, the present invention relates to a specialized glove for cleaning dishes and performing similar tasks.

There is always room to improve the tedious job of dishwashing. Even after the introduction of automatic dishwashing machines, the extreme versatility of the human hand remains the primary weapon in the war against the daily onslaught of dirty dishes. There are special tools for jobs that a scrub pad won't handle, but finding and storing these articles is a chore in itself. Some people, especially those affected by arthritis, find grasping a dishrag difficult. A single tool that uses the inherent agility and flexibility of the hand to handle common dishwashing situations is unavailable. The glove disclosed herein provides the necessary tools and keeps them literally at a user's fingertips. As such, the dishrag, scouring pad, cup brush, and other tools may be discarded as unnecessary. Furthermore, because the cleaning glove fits around the hand instead of being grasped, individuals with arthritis may use the device without pain.

Various proposals for cleaning gloves are found in the art. Such gloves are disclosed in U.S. Pat. Nos. 2,227,707; 2,745,128; 3,643,386; 4,038,787; 4,107,840; 4,621,388; 6,000,060; 6,016,571; and 6,018,837. While assumably effective for their intended purposes, the existing devices do not provide a cleaning glove with an artificial thumbnail and other strategically placed cleaning members for washing cups and dishes. The artificial thumbnail incorporated in the current invention provides a user with natural leverage when cleaning, and it is designed to be easily used. In fact, all of the features of the current invention are designed to take advantage of the hand's natural movements. Therefore, it would be desirable to have a cleaning glove having an artificial thumbnail and other strategically placed cleaning members for washing cups and dishes.

SUMMARY OF THE INVENTION

A cleaning glove according to the present invention includes a waterproof glove having at least one finger stall and a thumb stall, a rigid mounting plate mounted to the thumb stall, a rigid artificial thumbnail connected to the mounting plate, a cleaning material bonded to a palm portion of the waterproof glove, a first elongate scouring surface positioned on a thumbward side of a first finger stall and an outer end of the first finger stall, a second elongate scouring surface positioned on an exterior side of an outermost finger stall, and an elongate arm portion attached to the waterproof glove. The artificial thumbnail has a generally crescent-shaped configuration and protrudes from the thumb stall for scraping objects when a wearer's thumb moves the thumb stall in a back and forth motion. The mounting plate distributes the forces on the waterproof glove that result from the artificial thumbnail scraping objects, thus keeping the waterproof glove from tearing, and the mounting plate keeps the artificial thumbnail oriented so as to protrude away from the thumb stall.

In use, a wearer's hand is first inserted in the waterproof glove. The wearer may then wash dishes or perform other cleaning tasks. The wearer may use the artificial thumbnail to dislodge an object while cleaning by moving his thumb in a back and forth motion over the object. The configuration and the positioning of the artificial thumbnail provide the user with natural leverage when cleaning and take advantage of the hand's natural movements. The rigid mounting plate ensures that the forces from this scraping are distributed about the thumb stall, which keeps the waterproof glove from tearing. The cleaning material may be used to scour or to transport water and a cleaning agent, and the first elongate scouring surface allows the wearer to reach into and clean crevices and cup bottoms. By inserting his hand into a cup and rotating the cup relative to his hand, the wearer may use the first and second elongate scouring surfaces cooperatively for cleaning an inner surface of the cup. The elongate arm portion protects the wearer's hand by keeping dishwater from contacting the hand.

Therefore, a general object of this invention is to provide a cleaning glove that has an artificial thumbnail.

Another object of this invention is to provide a cleaning glove, as aforesaid, with other strategically placed cleaning members for washing cups and dishes.

Still another object of this invention is to provide a cleaning glove, as aforesaid, that eliminates the need for additional dishwashing tools.

Yet another object of this invention is to provide a cleaning glove, as aforesaid, that takes advantage of the hand's natural movements.

A further object of this invention is to provide a cleaning glove, as aforesaid, that is comfortable to wear.

A still further object of this invention is to provide a cleaning glove, as aforesaid, that protects a user's hands.

An even further object of this invention is to provide a cleaning glove, as aforesaid, that benefits all users, including those with reduced dexterity.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
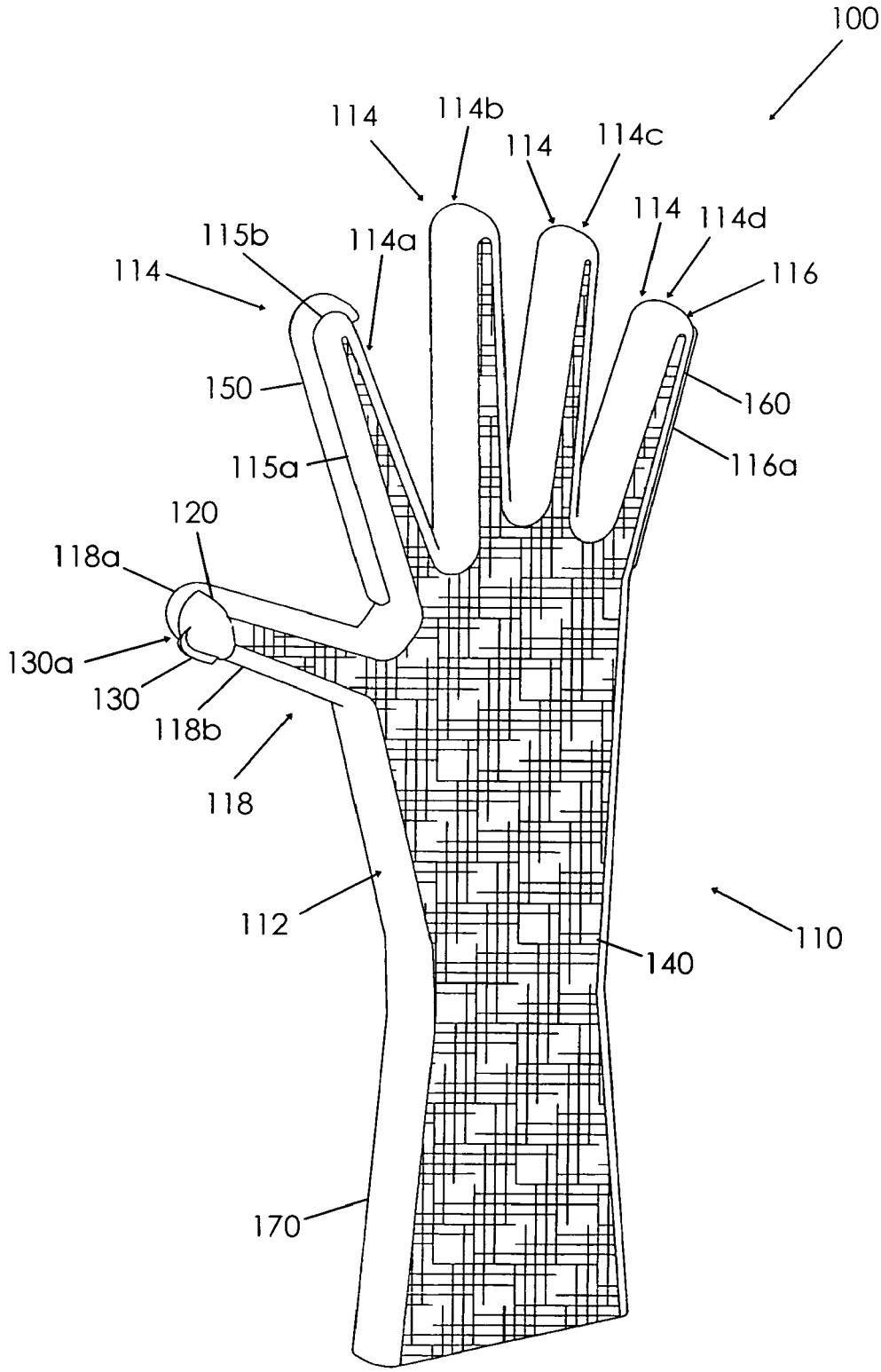
FIG. 1 is a perspective view of a cleaning glove for the left hand according to the present invention.

A cleaning glove according to the present invention will now be described in detail with reference to FIGS. 1 through 4 of the accompanying drawings. More particularly, a cleaning glove 100 includes a waterproof glove 110, a rigid mounting plate 120, a rigid artificial thumbnail 130, a cleaning material 140, a first elongate scouring surface 150, a second elongate scouring surface 160, and an elongate arm portion 170 (FIG. 1).

Figure 2:
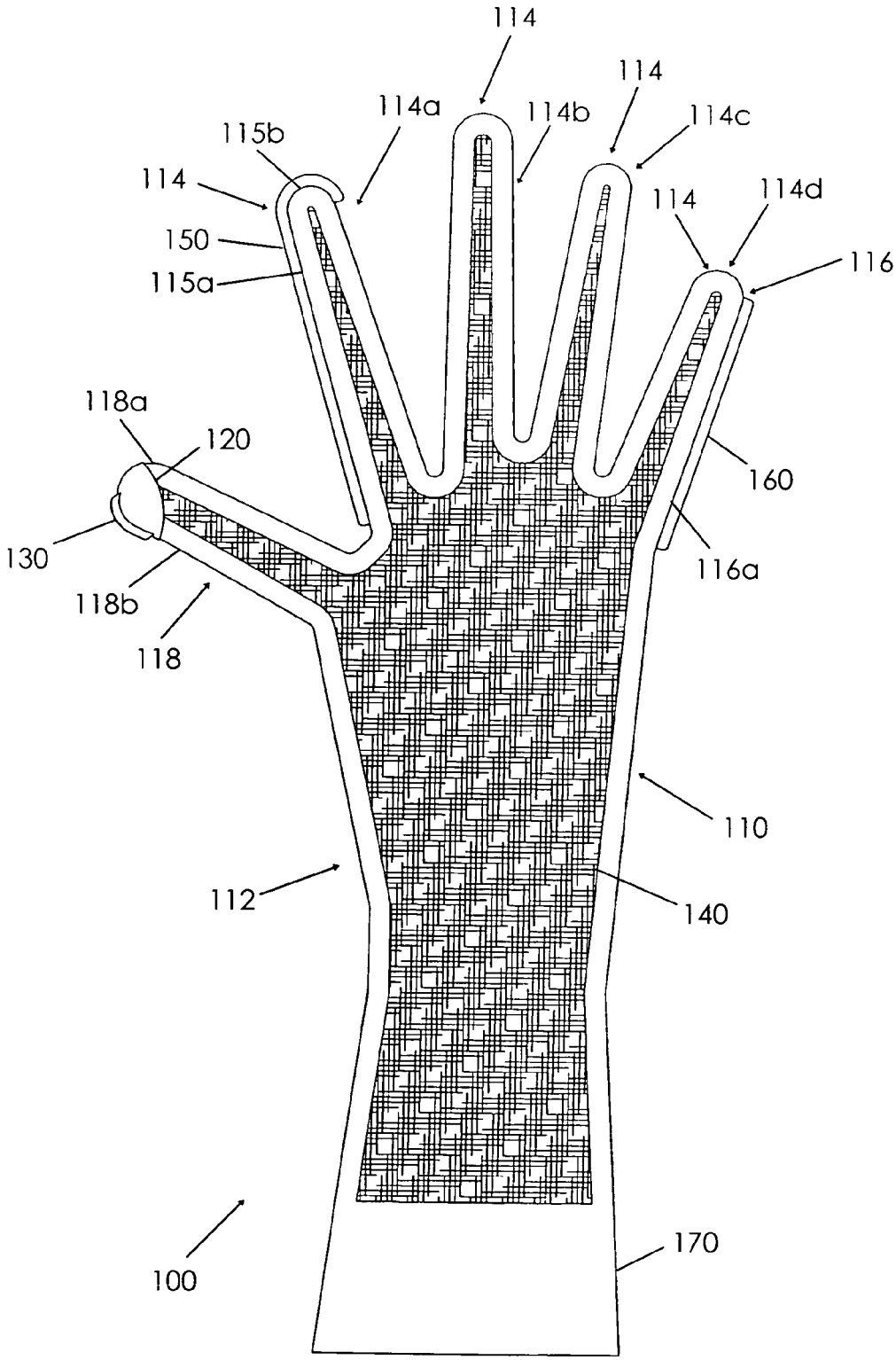
FIG. 2 is a front view of the cleaning glove as in FIG. 1.
Figure 3:
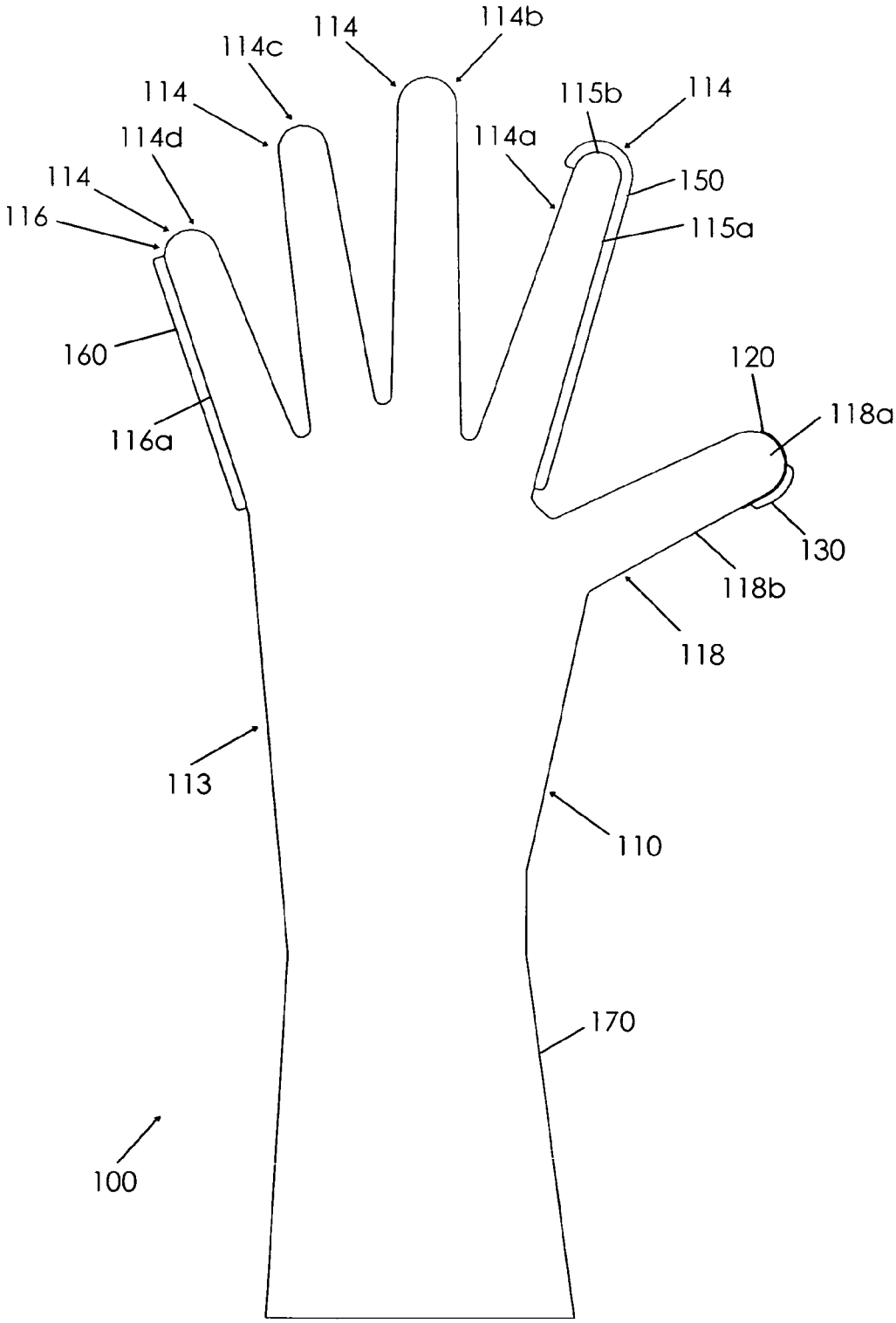
FIG. 3 is a rear view of the cleaning glove as in FIG. 1.

The waterproof glove 110 has a palm portion 112, a back portion 113, at least one finger stall 114, and a thumb stall 118 cooperatively conjoined to fit a wearer's hand (FIGS. 2 and 3; hand not shown). The at least one finger stall 114 is preferably a first, second, third, and fourth finger stall 114*a*, 114*b*, 114*c*, 114*d*, respectively, though either a single finger stall 114 or a plurality of finger stalls 114 would be acceptable. The finger stall 114 positioned closest to the thumb stall 118 is the first finger stall 114*a*, and the finger stall 114 positioned furthest from the thumb stall 118 may be referred to as the outermost finger stall 116. The waterproof glove 110 is preferably constructed of elastic, water impervious material such as latex, synthetic rubber, or natural rubber.

Figure 4:
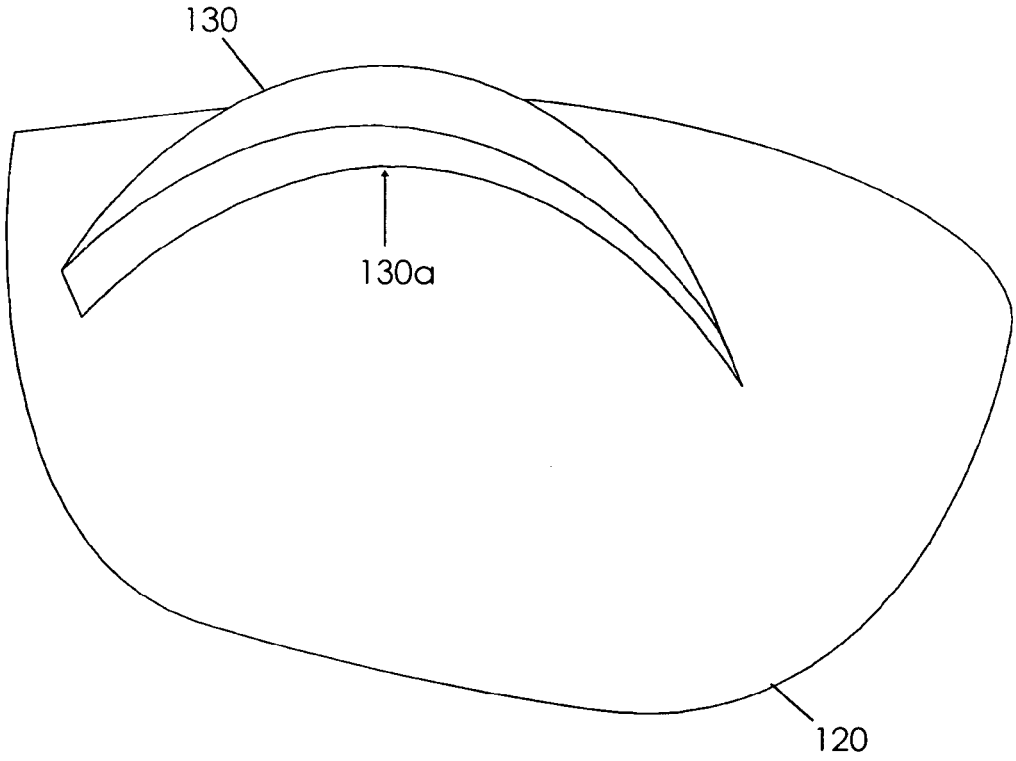
FIG. 4 is a perspective view of a mounting plate and an artificial thumbnail as in FIG. 1.

The rigid mounting plate 120 is mounted to the thumb stall 118 with the artificial thumbnail 130 being attached to the mounting plate 120 (FIG. 4). The artificial thumbnail 130 is preferably fixedly connected to the mounting plate 120, though this need not be the case. Indeed, the artificial thumbnail 130 may be removably connected to the mounting plate 120.

The artificial thumbnail 130 has a generally crescent-shaped configuration 130*a* and is positioned on a side 118*b* of the thumb stall 118 proximate an outer end 118*a* of the thumb stall 118 (FIGS. 1 and 2). The artificial thumbnail 130 protrudes from the thumb stall 118, for scraping objects when a wearer's thumb (not shown) moves the thumb stall 118 in a back and forth motion. In other words, the artificial thumbnail 130 provides the wearer with a rigid scraping surface. The configuration 130*a* and the positioning of the artificial thumbnail 130 provide the user with natural leverage when cleaning and take advantage of the hand's natural movements. The mounting plate 120 distributes the forces on the waterproof glove 110 that result from the artificial thumbnail 130 scraping objects. The mounting plate 120 also keeps the artificial thumbnail 130 oriented so as to protrude away from the thumb stall 118. While the artificial thumbnail 130 may be directly connected to the waterproof 110 without using the mounting plate 120, this is not preferred because the forces that result from the artificial thumbnail 130 scraping objects would be more concentrated, likely causing the waterproof glove 110 to tear.

The cleaning material 140 is bonded to the palm portion 112 of the waterproof glove 110 for absorbing a quantity of water or scouring (FIGS. 1 and 2). Extending from the palm portion 112, the cleaning material 140 is also bonded to the at least one finger stall 114 and the thumb stall 118 for scouring or for absorbing a quantity of water and thus allowing much of the cleaning glove 100 to act as a dishrag. While the cleaning material 140 is preferably a water-absorbent material or a scouring material such as knotted polyester, other cleaning materials may be suitable.

The first elongate scouring surface 150 is positioned on a thumbward side 115*a* of the first finger stall 114*a* and on an outer end 115*b* of the first finger stall 114*a* and bonded thereto (FIGS. 1 through 3). The second elongate scouring surface 160 is positioned on an exterior side 116*a* of the outermost finger stall 116 and bonded thereto (FIGS. 1 through 3) for cleaning an inner surface of a cup (not shown) cooperatively with the first elongate scouring surface 150 when a wearer's hand is inserted in the cup and rotated relative to the cup.

The elongate arm portion 170 extends from the palm portion 112 (FIG. 2) and the back portion 113 (FIG. 3) of the waterproof glove 110 for keeping dishwater from contacting a wearer's hand. The elongate arm portion 170 is preferably constructed of the same material as the waterproof glove 110, and the elongate arm portion 170 and the waterproof glove 110 are preferably constructed as a single piece.

In use, a wearer's hand is inserted in the waterproof glove 110 with his thumb positioned in the thumb stall 118 and his fingers positioned in the at least one finger stall 114. The wearer may then wash dishes or perform other cleaning tasks. To dislodge an object while cleaning, the wearer may use the artificial thumbnail 130 to scrape the object by moving his thumb in a back and forth motion over the object. The configuration 130*a* and the positioning of the artificial thumbnail 130 provide the user with natural leverage when cleaning and take advantage of the hand's natural movements. The rigid mounting plate 120 ensures that the forces from this scraping are distributed about the thumb stall 118, which keeps the waterproof glove 110 from tearing. The cleaning material 140 may be used to scour or to transport water and a cleaning agent (such as soap) to an object being cleaned in a manner similar to that of a dishrag. The first elongate scouring surface 150 allows the wearer to reach into and clean crevices as well as cup bottoms, due to the portion covering the outer end (115*b* of the first finger stall 114*a*. By inserting his hand into a cup and rotating the cup relative to his hand, the wearer may use the first and second elongate scouring surfaces 150, 160 cooperatively for cleaning an inner surface of the cup. The elongate arm portion 170 ensures that dishwater does not contact the wearer's hand.

It is understood that while certain forms of this invention have been illustrated and described, it is not limited thereto except insofar as such limitations are included in the following claims and allowable functional equivalents thereof.

What is claimed is:

1. A cleaning glove, comprising:

a waterproof glove having a palm portion, a back portion, four finger stalls, and a thumb stall cooperatively conjoined to fit a wearer's hand;

a rigid artificial thumbnail protruding from said thumb stall for providing the wearer with a rigid scraping surface;

a first elongate scouring surface positioned on a thumbward side of a first finger stall and on an outer end of said first finger stall and bonded thereto;

a second elongate scouring surface positioned on an exterior side of a fourth finger stall and bonded thereto for cleaning an inner surface of a cup cooperatively with said first elongate scouring surface when a wearer's hand is inserted in the cup and rotated relative to the cup;

wherein said artificial thumbnail has a generally crescent-shaped configuration and is positioned on a side of said thumb stall proximate an outer end of said thumb stall for scraping objects when a wearer's thumb is moved in a back and forth motion;

a rigid mounting plate mounted to said thumb stall with said artificial thumbnail being attached to said mounting plate;

a water-absorbent material bonded to said palm portion of said waterproof glove for absorbing a quantity of water; and wherein said water-absorbent material exends from said palm portion to said four finger stalls and said thumb stall of said waterproof glove and is bonded to said four finger stalls and said thumb stall for absorbing a quantity of water.

* * * * *